US005809597A

United States Patent [19]

Shaw

[11] Patent Number: 5,809,597

[45] Date of Patent: Sep. 22, 1998

[54] INFLATABLE BODY SUPPORT

[76] Inventor: Terry W. Shaw, 129 Springlake Estates, Quincy, Ill. 62301

[21] Appl. No.: 790,918

[22] Filed: Jan. 30, 1997

[51] Int. Cl.[6] ..... A47C 20/00

[52] U.S. Cl. ..... 5/655.3; 5/644; 5/640; 5/648; 5/632

[58] Field of Search ..... 5/630, 632, 636, 5/640, 644, 645, 648, 650, 710, 711, 655.3, 657

[56] References Cited

U.S. PATENT DOCUMENTS

| | | | |
|---|---|---|---|
| 2,604,641 | 7/1952 | Reed | 5/711 X |
| 2,614,272 | 10/1952 | Morner | 5/655.3 |
| 2,691,179 | 10/1954 | Kann | 5/710 |
| 3,298,044 | 1/1967 | Saltness et al. | 5/710 X |
| 3,308,489 | 3/1967 | Winkler . | |
| 3,428,974 | 2/1969 | Stuart . | |
| 4,405,129 | 9/1983 | Stuckey | 5/710 X |
| 4,685,163 | 8/1987 | Quillen et al. . | |
| 4,829,614 | 5/1989 | Harper . | |
| 5,044,030 | 9/1991 | Balaton | 5/710 |
| 5,086,529 | 2/1992 | Degroot . | |
| 5,333,336 | 8/1994 | Langsam | 5/655.3 X |
| 5,412,822 | 5/1995 | Kelly . | |
| 5,685,036 | 11/1997 | Kopfstein et al. | 5/710 |

*Primary Examiner*—Michael F. Trettel
*Attorney, Agent, or Firm*—Joseph W. Holloway

[57] ABSTRACT

A body support comprises an assembly of individually inflatable compartments arranged in an upper tier of body-supporting compartments and a subjacent tier of lifting compartments; and, the individual compartments vary in size and shape when fully inflated and may be partially inflated to modify the overall shape of the assembled support as desired.

21 Claims, 3 Drawing Sheets

INFLATABLE BODY SUPPORT

This invention relates generally to pneumatically inflatable supports of the multi-compartment type wherein each compartment may be selectively pressurized to provide variable degrees of firmness and vertical lift.

Supports of this general class are disclosed in U.S. Pat. No. 3,308,489 issued to Winkler for a cushion for resting legs, in U.S. Pat. No. 3,428,974 issued to Stuart for a compartmented air mattress, and in U.S. Pat. No. 5,412,822 issue to Kelly for an adjustable multi-compartment pneumatic support apparatus.

Winkler's leg cushion includes three inflatable loaf-shape parallelepipeds of like size and shape having contiguous vertical faces joined to form a medial compartment between laterally adjacent compartments. Each sealed compartment may be independently pressurized to establish its height and firmness.

Stuart contemplates a plurality of like compartments of rectangular shape which are detachably assembled to form a composite air mattress wherein highly pressurized compartments support heavier parts of the body while substantially deflated compartments underlie particularly sensitive body parts.

Kelly shows a plurality of elongated cylinders disposed horizontally adjacent one another and joined at their lines of contact. The diameters of these cylinders may be uniform or variable; and, these cylindrical compartments may be selectively pressurized to provide different degrees of firmness.

A shortcoming common to the above-mentioned pneumatically inflatable supports resides in a user's inability to regulate independently the support's lift versus its firmness. More particularly, the degree of pressurization of a given compartment of any of these prior art supports essentially fixes both its dimensions and its firmness under load thereby eliminating the opportunity to select individually an optimum height as well as an optimum degree of firmness for that compartment. This inherent characteristic of balloon-like body supports makes it impossible to increase the support's height without an increase in its firmness; and, contrariwise, the only means or lowering the compartment's supporting surface is to deflate the compartment with a concomitant loss of firmness. A dilemma of this nature confronts users of the Winkler leg cushion since any reduction made in a compartment's firmness to enhance dermal or muscular comfort could lower the height of the leg supporting surface below a height critical to the avoidance of thrombosis due to venous stasis. Likewise, the effectiveness of the Stuart and Kelly supports is likely to be diminished by a similarly unavoidable lift-versus-firmness compromise.

Another group of relevant prior art patents discloses the general concept of vertically disposed upper and lower compartments for an inflatable body support. Such supports are depicted in U.S. Pat. No. 4,829,614 issued to Harper for an adjustable pillow with a neck support, in U.S. Pat. No. 5,086,529 issued to DeGroot for a segmented support article; and, in U.S. Pat. No. 4,685,163 issued to Quillen for a recliner for medical convalescence.

The Harper pillow employs separately inflatable, elongated cylinders which are received in spaced cavities extending horizontally into the foam rubber body of the pillow. A pair of such horizontally oriented cylinders are disposed in vertically aligned cavities formed in a raised neck-supporting portion of the pillow body. Harper suggests that the firmness of the neck support can be selectively varied by regulating the pressurization of the cylindrical inserts disposed therein; however, the height or lift of the neck portion appears to remain constant due to the substantial bulk of the foam rubber body.

DeGroot discloses a plurality of selectively inflatable rectangular pillows joined in series by flexible hinges which bridge substantial spaces between the pillows. When connected, DeGroot's pillows may be laid out horizontally in a mattress-like fashion. Alternately, individual pillows may be swung vertically about their hinges to place them either on top of or underneath an adjacent pillow.

Quillen's air inflatable recliner includes a plurality of variably sized, rectangularly shaped cushions having conterminus edges joined together to form first and second sets of cushions. In turn, these sets are joined along a common edge for folding one set on top of the other set thereby to provide plural two-cushion stacks that form an upwardly sloped support surface.

These prior art body supports according to Harper, DeGroot and Quillen disclose inflatable compartments situated one above the other by folding of hinged compartments (DeGroot or Quillen) or by insertion of discrete compartments into vertically aligned cavities in the body of a support structure (Harper). None of these patentees distinguishes the supporting and lifting functions of their upper and lower compartments. Furthermore, none suggests that independent regulation of pressurization of vertically oriented compartments could provide a beneficial resolution of the firmness-versus-lift dilemma of the nature identified in the Winkler leg support patent. Because the supporting and lifting aspects of vertically arranged compartments have not been treated separately from an operational standpoint, the prior art support structures themselves have not been designed with this functional duality in mind. Instead, an assemblage of inflatable pillows or cushions of generally conventional shape and size are usually positioned one upon another to construct a composite support having the requisite vertical lift when the pillows are fully inflated.

SUMMARY OF THE INVENTION

The general object of this invention is to provide a novel pneumatically inflatable body support in the nature of a pillow or cushion which is structurally and operationally adapted to overcome the aforementioned shortcomings of previously known devices intended for the same purpose.

To this end, this invention discloses a highly adaptable pneumatic support comprising tiered compartments usable not only for positioning the spine in normal, healthy alignment as a user rests or sleeps in a supine position, but also for providing comfort and therapeutic benefit for those users who suffer abnormalities, pathological afflictions or injuries of the spine.

As will be more fully understood after consideration of the following specification, the increased adaptability of this pneumatic support is due in large part to its novel construction wherein the support comprises a plurality of individually inflatable compartments arranged in an upper tier of body support compartments and a subjacent or lower tier of lifting compartments. Each compartment of the lower tier is connected to and acts in concert with a corresponding superjacent compartment of the upper tier to establish and maintain, under load, the desired height or lift of the extreme top surface of such superjacent compartments. This vertically stacked arrangement of upper and lower tiers of compartments permits independent regulation of the height and firmness of each stacked pair of upper and lower compartments. Thus, the combined height of any given pair can be adjusted between extremes, as desired, by pressurization of one or both of the paired compartments while the degree of firmness of the support surface of the upper compartment depends solely upon the degree to which the upper compartment is pressurized. By this simple, but nonobvious means, the upper compartment can be custom inflated to a desired firmness while the height of the upper compartment's support surface can be independently regulated without regard to the specific firmness or softness selected for the upper compartment.

To further enhance the adaptability of the support disclosed herein, the size and shape of the several compartments which make up the support vary considerably. Thus, the vertical height of the lifting compartments comprising the lower tier if made uniform and less that the height of any of the superjacent supporting compartments which themselves vary in height. The widths of vertically stacked pairs vary to provide a plurality of body supporting surfaces having the same lengths, but individually varying widths. This provision of vertically stepped support surfaces having different widths together with the provision of a tier of vertically lifting compartments to regulate selectively the height of each support surface is a key feature of this invention.

The aforenoted variations in the size and height of the body-supporting surfaces of this tiered device together with the ability to inflate totally or only partially some or all of the compartments of either the upper or lower tier makes it possible to fashion a sculptured-like surface which precisely meets the needs of a wide range of potential users among whom are the following:

- Individuals without abnormal anatomical or pathological conditions who range in morphology and age from small children to large adults.
- Individuals with hyperkyphosis of the thoracic spine due to osteoporosis or other traumatic or pathological spinal fractures;
- Individuals suffering hyperlordosis of the cervival spine;
- Individuals who require elevation of the upper torso due to a heart condition, gastric reflux or hiatal hernia;
- Individuals with lower back problems who require elevation of the legs;
- Individuals suffering from thrombophlebitis or other arteriovascular inflammation of the lower limbs;
- Individuals who prefer or require a side-lying position when resting or sleeping; and,
- Individuals who require cervical traction.

Another object of this invention is to provide an inflatable body support which is highly portable and easy to store when collapsed, but is subsequently reinflatable to reproduce accurately a prescribed support configuration and firmness whenever it is again put into use.

Yet another object is to provide an inflatable support which is easy to clean, durably constructed and a amenable to low cost manufacture.

These and other advantages and objects of this invention and the manner of obtaining them will be best appreciated and fully understood by having reference to the following detailed description of the preferred embodiments of the invention taken in conjunction with the accompanying drawings.

DETAILED DESCRIPTION OF THE INVENTION

Figure 1:
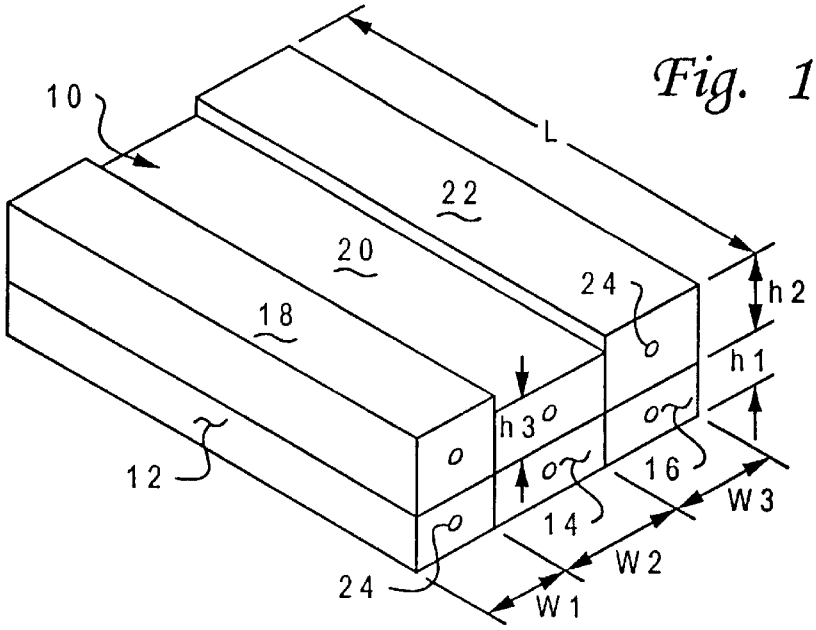
FIG. 1 is an overall perspective view of a support made in accordance with this invention.

Referring to FIG. 1 of the drawings, a support or pillow constructed according to this invention is designated in its entirety by numeral 10. Essentially, the composite support 10 comprises a plurality of inflatable compartmentized parallelepipeds having 6 rectangular faces. The elongated compartments are designated by numerals 12 through 22 and have a common length L, but differing widths $w_1$, $w_2$ and $w_3$ and differing heights $h_1$, $h_2$ and $h_3$ for a purpose to be explained. Hereinafter, compartments 12, 14 and 16 will be designated the lower tier of compartments; and, compartments 18, 20 and 22 will be designated the upper tier. The width $w_2$ of the compartments 14 and 20 is greater than the width $w_3$ of the end compartments 16 and 22 which is in turn greater than the width $w_1$ of the end compartments 12 and 18. Hereinafter compartments 14 and 20 will be referred to as the intermediate compartments; compartments 16 and 22 will be referred to as the wide end compartments; and, compartments 12 and 18 will be referred to as the narrow end compartments. In the disclosed embodiment of support 10, the height $h_1$ of the lower tier compartments 12, 14 and 16 is uniform and comprises two and one half inches. The height $h_2$ of the upper tier end compartments 18 and 22 is four inches; and, the upper tier intermediate compartment height $h_3$ is three inches. Preferably, the widths $w_1$, $w_2$ and $w_3$ are four inches, six inches and five inches, respectively. The dimension L which is common to all of the compartments which coact to make up the support 10 is preferably 24 inches.

The compartments may be fabricated from flexible sheets of a suitable polymeric resin such as polyvinylchloride (PVC), for example, which is imperviousto to air, displays good strength characteristics under static and flexural loading and exhibits high resistance to mechanical abrasion and to deterioration when exposed to water, oil, ultraviolet radiation and temperature extremes. This material is also preferred for its ability to be cleansed and kept in a highly sanitary condition.

Since neither the process for making the support 10 nor the means for doing so comprises a part of this invention, it will be understood that any of several well known methods for fabricating a hollow compartment having flexible plastic walls will suffice. The compartments 12 through 22 may be formed, for example, by thermally welding together various subassemblies of the entire support or by making each compartment as a unit followed by directly attaching the contiguious walls of such units to one another by bonding, cementing or the like process.

As will be apparent from the following description of the method by which the support 10 is put to beneficial use, it is necessary that each of the compartments is capable of being individually inflated or deflated by air supplied under pressure through a plurality of suitable valves 24 communicating with the interior of each compartment. To this end and as viewed in FIG. 1, an air valve of suitable construction and operation is located generally centrally of each of the individual compartment walls comprising the proximate side of the support 10. One economical, yet effective, class of inflation valve includes a flexible air tube extending from a body that is imperviously sealed in the wall of each compartment. The tube is provided at its free end with a sealable cap which may be easily opened or closed when the tube is withdrawn from the interior of the compartment. Thereafter, the entirety of the sealed tube is tucked into the valve body. Valves of this type are commonly used on water beds and on inflatable boats and floats.

From the foregoing description, it will be understood that the unitary support 10 is formed as an assembly of six rectangular air-inflatable compartments 12 through 22 in a lower tier of three compartments 12 through 16 and an upper tier of three compartments 18 through 22. Members of the upper and lower tiers are stacked vertically one upon the other to form three aligned pairs 12 and 18, 14 and 20, and 16 and 22 respectively. The vertical dimension or height of the lower tier compartments making up each pair is uniform. The horizontal dimension or width of the upper and lower compartments of each pair is the same. The width of each pair is different thereby providing a narrow pair 12 and 18, a wide pair 16 and 22, and an even wider intermediate pair 14 and 20 located between the wide and narrow pairs. The heights of the upper compartments 18 and 22, are the same and are greater than the height of the upper compartment 20.

As pointed out above in summarizing the invention, the adaptability of support 10 to a wide range of applications is made possible by two key structural features brought into combination, namely:

1) the support comprises an assembly of individually inflatable compartments arranged in an upper tier of body-supporting compartments and a subjacent tier of lifting compartments; and,
2) the individual compartments vary in size and shape when fully inflated and may be partially inflated to modify the overall shape of the assembled support as desired.

The versatility and efficacy of a support having these characterizing structural features will be more fully understood and appreciated from the following description of how the support may be beneficially employed by a variety of users.

Figure 2:
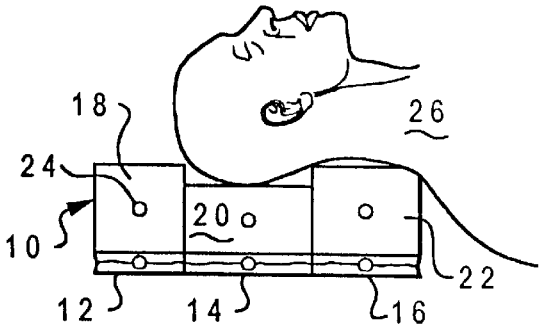
FIGS. 2 through 13 comprise side elevational views of the support shown in FIG. 1 wherein the plural compartments of the support are inflated to varying degrees for providing underlying support for the depicted body member; and, FIG. 14 is an enlarged end elevation depicting indicia imprinted upon the ends of individual compartments.

FIG. 2 shows the support 10 configured to provide a pillow which might be used by an average size adult for reclining in a supine position. The lower tier compartments 12, 14 and 16 are all fully deflated by means of air valves 24 associated therewith. Depending on the cervical length of the user, either the narrow compartment 18 or the wide compartment 22 will be situated under the user's neck. With the neck so supported in a normal lordotic or forward curve, the occiput rests upon compartment 20 and the upper thorax may rest upon an underlying bed or like surface. The vertical lift provided to the occiput is the height $h_3$ of the fully inflated intermediate upper tier compartment 20 combined with the negligible height of the collapsed intermediate lower tier compartment 14 or a little more than three inches. The vertical support underlying the neck is the combined height of compartments 16 and 22 or about four inches. The vertical lift of the compartments 20 and 22 may be adjusted to better suit the specific anatomical make up of the user by partially deflating one or both of these compartments. It should also be obvious that the support can be turned end for end to place the narrow compartment 18 under the user's neck should the width $w_3$ of the top surface of compartment 22 be too great to permit the neck to rest comfortably thereupon.

It will be understood that the firmness of compartments 20 and 22 which are in contact with the user's body will be greatest when they are inflated to their maximum air pressure, as depicted in FIG. 2. Should a lower degree of firmness be desired by the user, either or both of these compartments could be slightly deflated at the expense of some decrease in the lift originally provided. However, in accordance with a highly advantageous feature of this invention, any loss in lift provided by upper tier compartment 22, for example, could be made up by a compensating increase in the inflation of its subjacent lower tier compartment 16. By this means the user can decouple the reciprocal relationship between the firmness and the effective height of the upper tier compartments.

Figure 3:
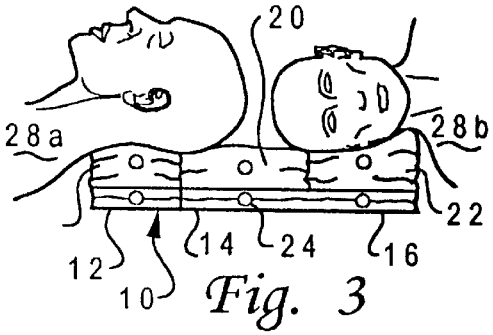

FIG. 3 further illustrates the adaptability of support 10 to the needs of a user 28 shown in a supine position 28*a* in the left-hand portion of the drawing and in a side-lying position 28*b* in the right-hand portion of this figure. User 28 displays the morphology of a child or small adult in that he has a relatively short lordotic curve extending from the occiput to the first thoricic vertebrae, as well as a relatively narrow lateral spacing between the outside surface of the shoulder and the proximate side surface of the neck. In the supine position 28*a,* the user employs the stacked narrow end compartments 12 and 18 to furnish the desired cervical support, while the opposed wide end compartments 16 and 22 are used to support the side of the head and the neck in the side-lying position 28*b.*

Due to the reduced lift requirements involved in the supine or left-hand position 28*a,* not only are the lower tier lifting compartments 12, 14 and 16 totally deflated, but the upper tier compartment 18 directly underlying the neck and head is appropriately deflated. Compartment 22 may remain fully inflated at height $h_2$ or it may be deflated to any lesser height generally corresponding to the lateral distance between the user's shoulder and his neck. If necessary for maximum comfort, the intermediate upper tier compartment 20 may be reduced in height to correspond with that of compartment 18 or 22 depending on which of the latter compartments is supporting the user's head.

Figure 4:
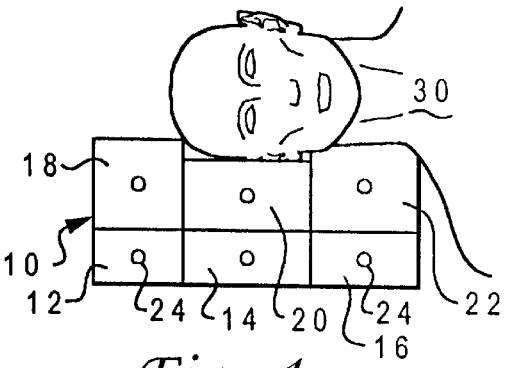

FIG. 4 shows the support 10 in its fully inflated condition and underlying the head and neck of a large adult user 30 situated in a side-lying position. The wide end compartments 16, 22 are best suited to underly and support the relatively long neck of the user. The sizeable head of user 30 rests atop compartment 20 in the stepped depression formed intermediate the ends of the top support surface by intentionally making the height of compartment 20 somewhat less than that of the upper tier end compartments 18 and 22. The vertical head and neck lifts provided by paired compartments 14, 20 and 16, 22 are shown at their maximums of $h_1+h_3$ and $h_1+h_2$ respectively. If support 10 were to be utilized by user 30 in the supine position, both compartments 14 and 16 could be selectively deflated to reduce the lift provided by these compartments to lower the top support surface to better fit the cervical curve of the user, however, without disturbing the desired original firmness of the fully inflated compartments 20 and 22.

Figure 5:
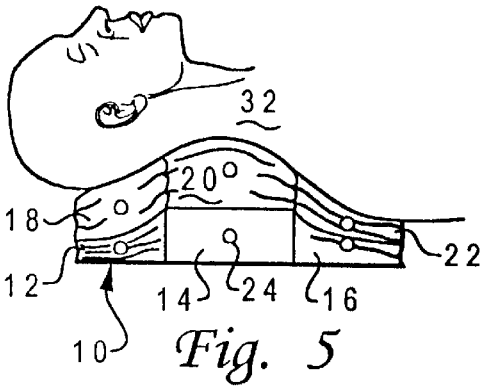

Not only is the support 10 structurally and functionally adapted to provide a comfortable and healthy spinal alignment aid for average or normal users of all sizes and ages, but sufferers of spinal abnormalities, spinal pathologies and other physical conditions requiring specialized support of the body will also benefit from the adaptability of the hereindisclosed support. For example, FIG. 5 shows a user 32 who needs substantial neck support and who also suffers from a heart or stomach disorder which requires elevation of the shoulders and upper thorax. In this instance, compartment 12 of the lower tier is substantially deflated while the intermediate compartments 14 and 20 are inflated to their maximum combined height $h_1+h_3$. Compartment 18, upon which the occiput is supported, is inflated sufficiently to create the desired curvature of the cervical vertebrae overlying compartment 20; and, compartments 16 and 22 are inflated only enough to provide a cushioned support under the elevated shoulders.

Figure 6:
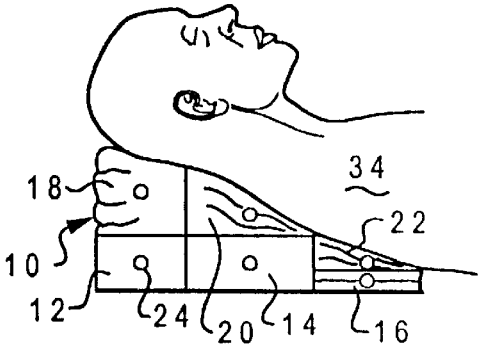

FIG. 6 shows that the support 10 may have a generally wedge-shaped or sloping configuration wherein compartments 12, 14 and 18 are fully inflated, intermediate compartment 20 is partially inflated, and compartments 16 and 22 are substantially deflated. As so configured, the support 10 can be put to beneficial use by a user 34 who requires thoracic elevation and who also exhibits cervical hyperlordosis. Thus, the occiput rests firmly on the fully inflated compartment pair 12, 18 while compartment 20 would be substantially collapsed under the neck to produce a reduction in the abnormal lordotic curvature of the cervical vertebrae. The shoulders and chest are inclined upwardly by compartment 20, the fully inflated compartment 14, and the substantially deflated compartments 16 and 22. The full lifting capacity of the lower tier compartments 12 and 14 is utilized while compartment 18 is deflated just enough to provide reduced firmness beneath the head. It will be noted that graduated pressurization of the connected upper tier of compartments 18, 20 and 22 provides a smooth transition between compartments and a desirable shaping of upper surfaces of these compartments to the user's neck and back.

Figure 7:
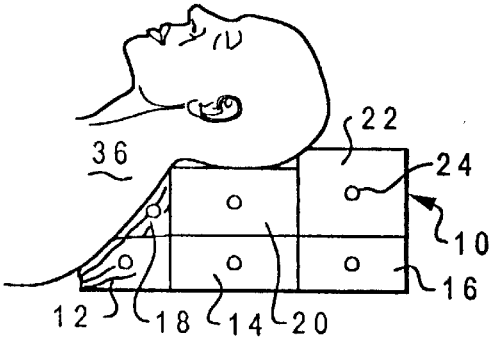

FIG. 7 illustrates the utilization of support 10 by an individual 36 who suffers a hyperlordosis of the cervical spine and a hyperkyphosis of the thoracic spine. The user's outwardly curved back rests on the sloping end of support 10 defined by the substantially deflated upper compartment 18 and the substantially fully inflated lower compartment 12 while the occiput is lifted by the fully inflated compartments 14 and 20. This positioning of the back, neck and head biases the neck forwardly whereby the cervical spine is urged toward a more normal lordotic alignment and the hyperkyphotic projection of the upper thoracic spine is somewhat reduced.

Figure 8:
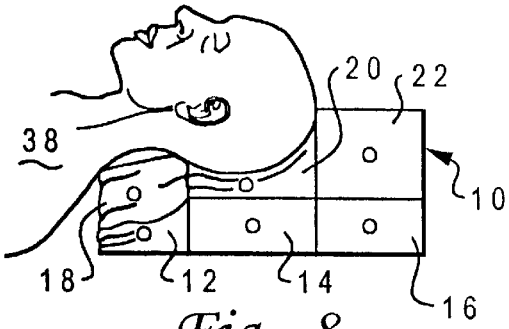
Figure 9:
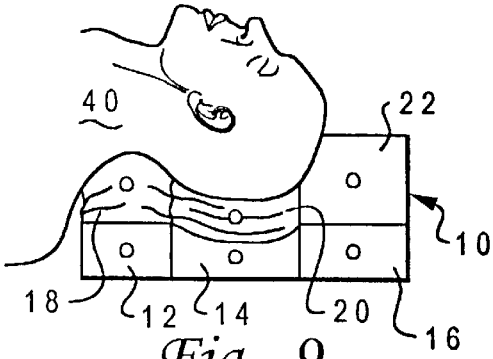

FIGS. 8 and 9 show users 38 and 40, respectively, who suffer progressively greater degrees of thoracic kyphosis. Because of the substantial extension of the upper thoracic spine in both cases, the surfaces underlying the head and neck of users 38 and 40 must be appropriately elevated by inflating compartments 12, 14, 18 and 20 to a substantial degree. FIG. 8 reveals that compartment 18 has been deflated slightly to reduce the firmness of the support surface for the neck of user 38 and that the height of this support surface has been regulated by only partially inflating compartment 12. In FIG. 9 the user 40 has an increased thoracic kyphosis and a severe kyphotic change in the cervical spine. In this instance, full inflation of compartment 12 and reduced inflation of the intermediate compartments 14 and 20 is required to provide upward pressure on the cervical vertebrae overlying the top of compartment 18 sufficient to aid in the normalization of the cervical curve.

Figure 10:
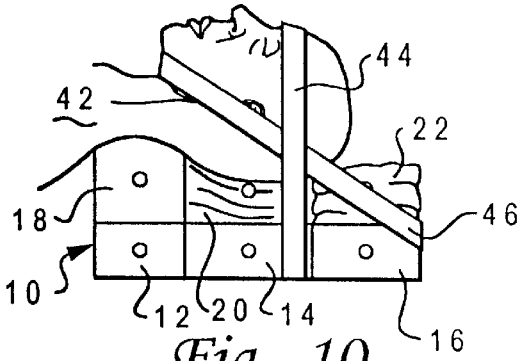
Figure 11:
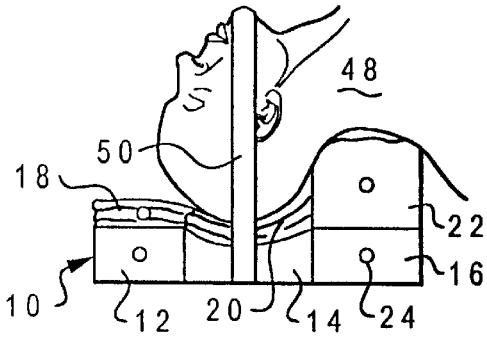

FIGS. 10 and 11 illustrate two applications of the pneumatic support 10 being used as a cervical traction device. In FIG. 10 the user 42 positions his neck on the fully inflated and fully elevated compartment 18 with the occiput spaced above the top of partially deflated compartment 20. Two flexible straps 44 and 46 including length adjusting devices, not shown, are employed to apply tractive force to the user's neck. Strap 44 extends about the user's forehead and the intermediate compartments of support 10. Strap 46 passes under the user's chin then around those end compartments of support 10 proximate the top of the user's head. The straps may be made of any suitably strong, non-elastic material such as nylon webbing; and, the adjusting devices may comprise coacting members of a hook and loop type of fastening means. In operation, strap 44 would be selectively shortened to draw the head downwardly thereby increasing the cervical lordosis created by the reactive pressure of compartment 18 upon the neck. At the same time, selective shortening of strap 46 will draw the head toward compartments 16 and 22 thereby increasing the extension of the neck to a desired degree.

FIG. 11 shows how support 10 can be used as a cervical traction device for an individual 46 having a hyperkyphotic cervical spine. In this case, the neck of user 48 is elevated slightly above the upper surface of compartment 22, and the occipital region of the head is vertically spaced from the underlying surface of the collapsed compartment 20. A strap 50, which may be the same as or similar to strap 44 is placed under the user's chin and then drawn down and around the bottom surface of intermediate compartment 22. Strap 50 is then selectively shortened thereby moving the head downwardly into extension with sufficient force to draw the cervical area into contact with cushion compartment 22. From the previous description of support 10, it will be appreciated that the tractive force applied to users of the devices shown in FIGS. 10 and 11 can be incrementally varied not only by adjusting the described straps, but also by selectively increasing or decreasing the pressurization of certain inflatable compartments.

Figure 12:
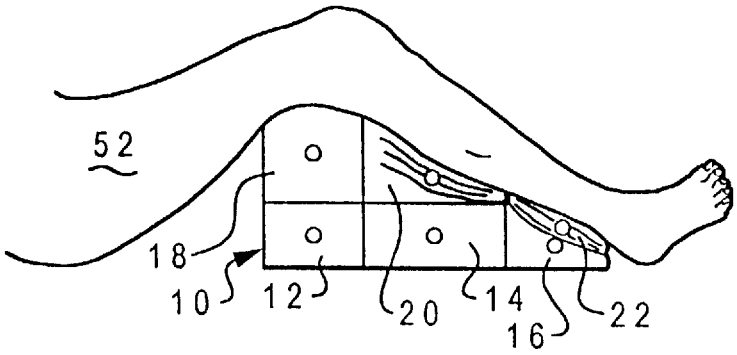

FIG. 12 shows a support 10 similar to that depicted in FIG. 6, but being used for a dissimilar purpose. In this case, support 10 underlies the lower extremities of a user 52 who requires elevation of the knee and thigh. The user's knee rests upon the compartment pair 12, 18 which is inflated to the maximum available elevation of $h_1+h_2$; and, the leg depends downwardly with the calf and ankle being supported upon compartments 20 and 22, respectively. Alternatively, the support could be reversed with respect to the user and the heels placed atop compartment 18. Thereafter, with an appropriate reduction in the combined height of compartments 12 and 18, the user's feet would be elevated at a prescribed height, but the calves would be unsupported thereby aiding vascular circulation without putting undue stress on the muscles in the calf and thigh areas.

Figure 13:
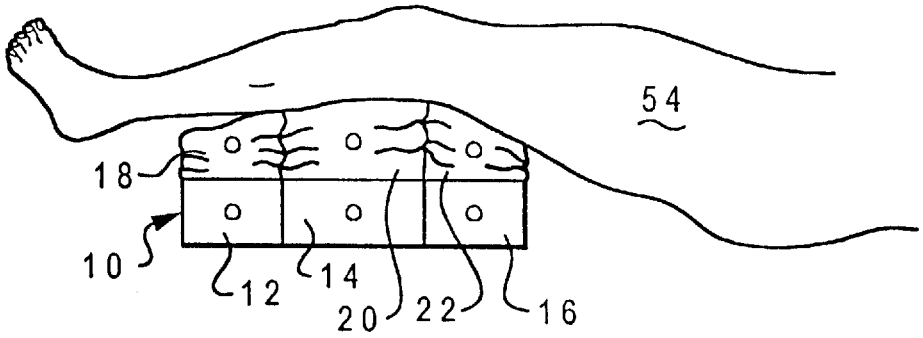

FIG. 13 depicts another useful leg support which employs the advantageous features of support 10 to relieve spasm of the back muscles in order to flatten the user's lumbar spine. User 54 is shown in the supine position with his calf and thigh resting upon the convexly curved upper surface of support 10 defined by inflating the various compartments to the degree shown in the drawing. It will be understood that the height and shape of the surface supporting the calf and thigh can be selected to reduce the lordotic curvature of the lumbar spine to permit the lower back to relax comfortably upon an underlying bed or the like.

Figure 14:
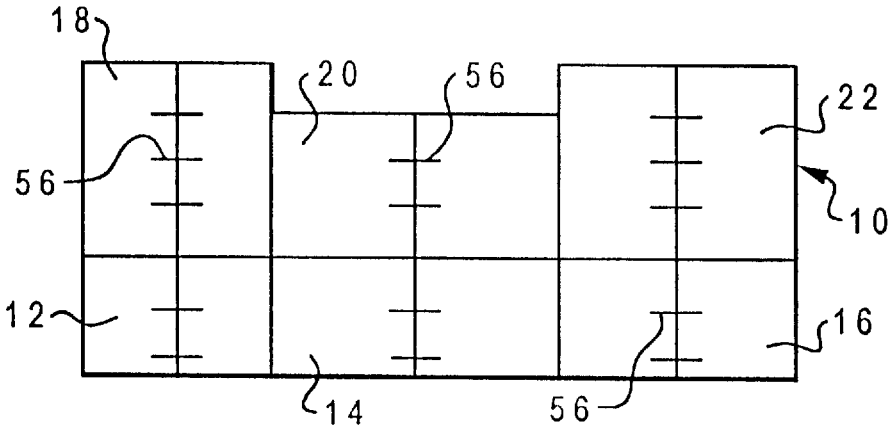

The foregoing examples of the rest-enhancing and therapeutic applications of support 10 suggests that a support of such varied utility would be especially adept at filling the needs of those users confined to hospitals and nursing homes. In such settings, ill or infirm users would have the assistance of expert diagnosticians and therapists in selecting and creating a specific configuration of the support most appropriate to the individual's needs. However, with only basic operating instructions and slight experience, support 10 can be properly inflated by ordinary users who employ the cushion mainly as an improved pillow for comfort and beneficial support during resting or sleeping periods. Where the support 10 is employed in the home to provide pain relief or active therapy to treat spinal abnormalities, pathological conditions or traumatic injuries, a trained professional should be consulted to obtain an initial evaluation and a prescription for specific inflation levels or pressures for support 10 which will produce the most beneficial support configuration and firmness for correcting the diagnosed problem.

Where long-term use of support 10 is required, modifications of these prescribed pressure levels may be appropriate as the individual's treatment progresses. The user may also be required to reinflate the support's compartments after they have been collapsed to facilitate storage or transportation. Therefore, to provide a helpful guide for the home user in maintaining or reproducing a prescribed inflation level for each of the six compartments of support 10, permanent indicia, such as that shown in FIG. 14, are provided on the valved face of each compartment. Along the vertical centerline of each compartment 12 through 22, horizontal markers 56 are placed at suitably graduated intervals to indicate the inflated height of each compartment.

It may be desirable to encase the support in a suitable covering, not shown, which can be removed from time to time for laundering and sanitation. A correctly sized and shaped slipcase or wrap could be made of soft yet durable fabric such as a blend of cotton and polyester. The covering may have a suitable closure such as a zipper or hook and loop tabs preferably located at the valved end of the support 10 for easy access thereto.

While the aboveindicated physical dimensions of support 10 are well suited to accommodate a sizeable range of user morphologies, these dimensions can be changed to meet a need for support sizes and shapes falling outside this range. It is also within the purview of this invention to provide a support assembly having more than two tiers of inflatable compartments as well as compartments attached laterally to the end compartments 12, 18 and 16, 22.

Having described in detail the structure and a representative number of possible applications of the illustrated embodiment of the invention, it will be appreciated that the tiered construction of the air compartments and their disclosed shapes and sizes all contribute to the realization of the objects set forth and coact in a novel and advantageous manner to provide an inexpensive, durable and easily used and understood device which demonstrates surprising adaptability and versatility in application and superior results in its principal function as a body support.

It will also be further understood by those familiar with the design and manufacture of inflatable supports that various changes in size, shape, materials and methods as well as specific details of the illustrated construction may be made without departing from the scope and spirit of the invention.

I claim as my invention:

1. An inflatable body support, comprising in combination:

a) an assembly of compartments having flexible walls impervious to air;

b) valve means associated with each of said compartments for selectively inflating said compartments to a desired pressure;

c) each of said compartments having the general shape of a parallelepiped;

d) said compartments being assembled in at least one upper horizontally extending tier and at least one lower horizontally extending tier;

e) said tiers being vertically stacked and each of said compartments in said upper tier being vertically aligned with a subjacent compartment in said lower tier; and, f) each of said compartments in said upper tier varies in width from any other compartment in said upper tier.

2. The support set forth in claim 1, wherein:

each of said subjacent compartments in said lower tier has the same width as an upper tier compartment which is vertically aligned therewith.

3. An inflatable body support, comprising in combination:

a) an assembly of compartments having flexible walls impervious to air;

b) valve means associated with each of said compartments for selectively inflating said compartments to a desired pressure;

c) each of said compartments having the general shape of a parallelepiped;

d) said compartments being assembled in at least one upper horizontally extending tier and at least one lower horizontally extending tier;

e) said tiers being vertically stacked and each of said compartments in said upper tier being vertically aligned with a subjacent compartment in said lower tier; and, f) said compartments in said upper tier vary in height.

4. The support set forth in claim 3, wherein:

said compartments in said lower tier are uniform in height.

5. An inflatable body support, comprising in combination:

a) an assembly of compartments having flexible walls impervious to air;

b) valve means associated with each of said compartments for selectively inflating said compartments to a desired pressure;

c) each of said compartments having the general shape of a parallelepiped;

d) said compartments being assembled in at least one upper horizontally extending tier and at least one lower horizontally extending tier;

e) said tiers being vertically stacked and each of said compartments in said upper tier being vertically aligned with a subjacent compartment in said lower tier;

f) each of said tiers includes a like number of compartments;

g) said upper and lower tiers provide three pairs of vertically stacked compartments, said pairs having widths which vary one for the other; and h) the one pair having the greatest width is disposed intermediate the other pairs.

6. The support set forth in claim 5, wherein:

the compartments comprising said pair having the greatest width have a combined height less than the combined height of either of said other pairs.

7. The support set forth in claim 6, wherein:

the combined heights of said other pairs are the same.

8. An inflatable body support, comprising, in combination:

a) an assembly of compartments having flexible walls impervious to air;

b) valve means associated with each of said compartments for selectively inflating said compartments to a desired pressure;

c) each of said compartments having the general shape of a parallelepiped;

d) said compartments being assembled in at least one upper horizontally extending tier and at least one lower horizontally extending tier; and, e) height indicating indicia is carried by each of said compartments.

9. The support set forth in claim 8, wherein:

said indicia is located proximate said valve means.

10. An inflatable body support, comprising in combination:

an assembly of a plurality of individual compartments each having flexible walls impervious to air and each having an individual air valve opening through a wall thereof;

a plurality of said compartments being laterally assembled and comprising an upper tier of compartments;

a plurality of said compartments being laterally assembled and comprising a lower tier of compartments; and, said compartments comprising said upper tier being assembled with subjacent compartments comprising said lower tier.

11. The inflatable body support set forth in claim 10, wherein:

said tiers are vertically stacked and each of said compartments in said upper tier is vertically aligned with a subjacent compartment in said lower tier.

12. The inflatable body support set forth in claim 11, wherein:

each of said subjacent compartments in said lower tier has the same width as an upper tier compartment which is vertically aligned therewith.

13. The inflatable body support set forth in claim 10, wherein:

said compartments in said upper tier vary in width.

14. The inflatable body support set for in claim 10, wherein:

each of said compartments in said upper tier varies in width from any other compartment in said upper tier.

15. The inflatable body support set forth in claim 10, wherein:

said compartments in said upper tier vary in height.

16. The inflatable body support set forth in claim 10, wherein:

said compartments in said lower tiers are uniform in height.

17. The inflatable body support set forth in claim 10, wherein:

height indicating indicia is carried by each of said compartments.

18. The inflatable body support set forth in claim 10, wherein:

each of said tiers includes a like number of compartments.

19. The inflatable body support set forth in claim 18, wherein:

said upper and lower tiers produce three pairs of vertically stacked compartments, said pairs having widths which vary one from the other.

20. The inflatable body support set forth in claim 19, wherein:

the compartments comprising said pair having the greatest width have a combined height less than the combined height of either of said other pairs.

21. The inflatable body support set forth in claim 20, wherein:

the combined heights of said other pairs are the same.

* * * * *